US008240479B2

(12) United States Patent
Loce et al.

(10) Patent No.: US 8,240,479 B2
(45) Date of Patent: Aug. 14, 2012

(54) FLICKER BOXES

(75) Inventors: Robert P. Loce, Webster, NY (US); Barry G. Gombert, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 275 days.

(21) Appl. No.: 12/788,502

(22) Filed: May 27, 2010

(65) Prior Publication Data

US 2011/0290795 A1 Dec. 1, 2011

(51) Int. Cl.
*B65D 73/00* (2006.01)

(52) U.S. Cl. ..... 206/769; 206/459.1; 206/457

(58) Field of Classification Search ..... 206/457, 206/459.1, 459.2, 736, 767, 45.28, 769, 771, 206/772

See application file for complete search history.

(56) References Cited

U.S. PATENT DOCUMENTS 3,121,511 A * 2/1964 Whitehead ..... 221/283
5,836,095 A * 11/1998 Crowell ..... 40/299.01
6,178,672 B1 * 1/2001 Inbar et al. ..... 40/361
2003/0150856 A1 * 8/2003 Jalet et al. ..... 220/4.03
2003/0181844 A1 * 9/2003 Bernard ..... 604/15
2008/0034627 A1 * 2/2008 Schnuckle ..... 40/306
2008/0187688 A1 * 8/2008 Gunther ..... 428/13
2009/0197231 A1 * 8/2009 Sosalla ..... 434/267

* cited by examiner

*Primary Examiner* — Jacob K Ackun
(74) *Attorney, Agent, or Firm* — Fay Sharpe LLP

(57) ABSTRACT

Systems and methods are described that facilitate generating a changing visual effect during opening and closing of a package for a product. The package includes first and second portions, each having thereon an polarized interference region with non-parallel planes of polarization. All or part of the second package portion is transparent to one polarization, permitting the polarized interference region on the first package portion to interact with a polarized interference region on the second package portion. The package portions are mated together (e.g., in a tube and sleeve arrangement or the like), such that the polarized regions are aligned and overlap each other when the package is closed, thereby permitting less light through due to the two overlapping planes of polarization. As the package is opened (or closed), the polarized regions move or slide past each other, creating the visual effect by changing the size and shape of the overlapping polarized region. As the package is opened or closed, light passage through interactive regions where the polarized regions overlap is reduced or eliminated, depending on the orientation of the planes of polarization.

20 Claims, 5 Drawing Sheets

FLICKER BOXES

BACKGROUND

The subject application relates to visually interactive packaging systems and methods. While the systems and methods described herein relate to visually interactive packaging and the like, it will be appreciated that the described techniques may find application in other packaging systems, other visual effect applications, and/or packaging methods.

Novel and interesting packaging can help sell products, so there is always a need to develop packaging that will grab the attention of shoppers. In order to entice shoppers, scanimation techniques have been used to produce moving patterns that create a visual effect or illusion when an overlay is moved past another pattern. For example a pattern of intermittent lines and/or dots representing an image in various positions is printed on a first surface (e.g., a page), and an overlay comprising a complementary pattern of dots and/or lines is then moved over the printed pattern to create an illusion that the subject of the printed image is changing position (e.g., an animal running, a word appearing and disappearing, etc.). That is, as lines in the overlay pattern align with lines in the printed pattern, the image subject appears to be in a first position. As the overlay pattern is moved slightly, the overlay pattern lines align in a new orientation relative to the printed pattern to make the image subject appear to be in a second position, and so on. The lines of the printed pattern and overlay pattern are sufficiently close together to make the motion of the image subject appear fluid and seamless.

However, there is an unmet need for systems and/or methods that facilitate or create moving visual effects via the act of opening a package using polarized materials, and the like.

BRIEF DESCRIPTION

In accordance with various aspects described herein, systems and methods are described that facilitate generating a moving visual effect during opening and closing of a package using overlapping slidable light polarization filters. For example, a package that generates a moving visual effect when opened or closed comprises a first package portion with a first polarized interference region on an surface thereof, the polarized interference region having first plane of polarization, and a second package portion with a second polarized interference region having a second plane of polarization that is oriented at an angle in the range of 0° to approximately 90° relative to the first plane of polarization. The first and second polarized interference regions are aligned and overlapping when the package is closed, thereby forming an interactive interference region. The first and second polarized interference regions are slidable past each other during opening and closing of the package, thereby creating the moving visual effect, in which the shape and size of the interactive interference region changes.

According to another aspect, a method of generating a changing visual effect during opening and closing of a package comprises defining a first polarized interference region on a first package portion, defining a second polarized interference region on a second package portion that mates with the first package portion to form the package, applying a polarizing material to the first polarized interference region that polarizes light in a first plane of polarization, and applying the polarization material to the second polarized interference region that polarizes light in a second plane of polarization that is oriented at an angle in the range of 0° to approximately 90° relative to the first plane of polarization. The method further comprises mating the second package portion to the first package portion to form the package. The first and second polarized interference regions are aligned and overlapping when the package is in a closed state. The first and second package portions are slidable relative to each other and create a changing visual effect when the polarized interference regions slide past each other during opening or closing of the package.

DETAILED DESCRIPTION

In accordance with various features described herein, systems and methods are described that provide a package that opens in a manner that creates dynamic visual effects through the use of moving polarized interference regions. According to one aspect, the package is constructed of an inner body and a transparent (e.g., to one polarization, etc.) outer body (e.g., a sleeve), such that the outer body slides off of the inner body to open the package. As used herein, "transparent" connotes light transmittance consistent with a single plane of polarization, as light traverses a polarized material that is polarized in a single plane. For instance, such light transmittance may be on the order of approximately 30-50% or so for a single plan of polarization.

In one embodiment of the herein-described packages, systems, and/or methods, all or a portion of the outer body is transparent to one polarization (i.e., approximately 30-50% light-transmissive), and may comprise a transmissive filter material. The inner body has a polarized interference region (e.g., a transmissive filter material, etc.) on its outer surface and the outer body has complementary second polarized interference region (e.g., a transmissive filter material), the second polarized interference region having a plane of polarization that is not parallel to a plane of polarization of the first polarized interference region. For example, the first and second interference regions may comprise transmissive filter material having a transmittance of approximately 40%, individually. If the interference regions are aligned and overlapped so that their planes of polarization are parallel, transmittance through both regions may be approximately 30%. If the planes of polarization are arranged orthogonally, transmittance may approach 0%. Orientation of the polarization planes somewhere between 0° and 90°, in this example, is therefore somewhere between 30% and 0%, and decreases as the orientation approaches 90°. As the outer body is slid off the inner body, the amount of light transmission through the package changes due to the change in relative positions of the polarized interference regions, creating a visually detectable event.

Figure 1:
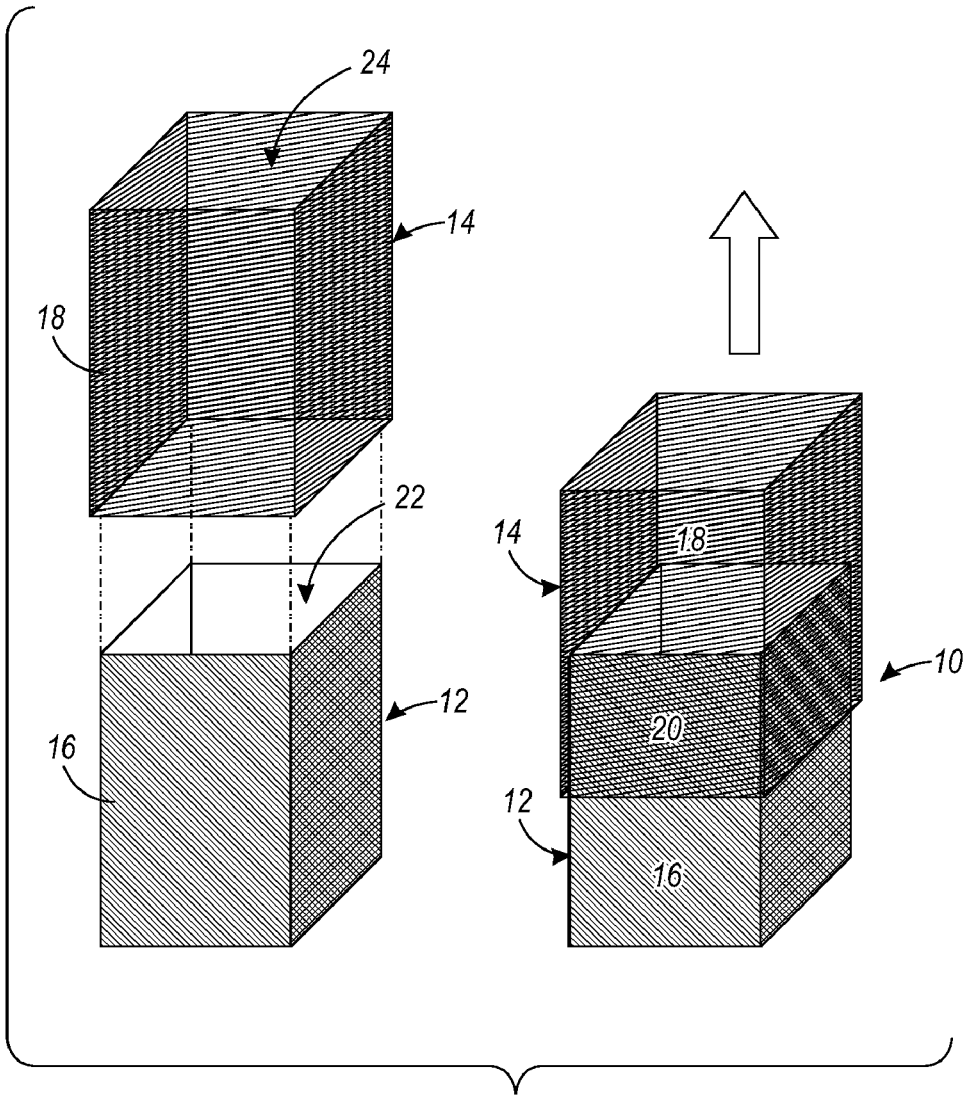
FIG. 1 illustrates an example of a package that opens in a manner that creates a dynamic visual effect via moving polarized interference regions.

FIG. 1 illustrates an example of a package 10 that opens in a manner that creates a dynamic visual effect via moving polarized interference regions. The package 10 is constructed of an inner body 12 and transparent (e.g., fully transparent, semi-transparent, etc.) outer body 14 (e.g., a sleeve), such that the outer body 14 is slid off the inner body 12 to open the package 10. The inner body 12 has a transparent polarized region 16 on at least a portion of its outer surface, and the outer body 14 has a complementary polarized interfering region 18 on one or both of its surfaces. As the outer body is slid or pulled off of the inner body, an interactive interference region 20 changes due to the change in relative positions of respective planes of polarization of the polarized regions 16, 18 with respect to each other. More generally stated, at least a portion of the outer body 14 is transparent to one polarization (e.g., approximately 30-50% light-transmissive) and is has a polarized region 18, and at least that portion of the outer body is slid past a complementary polarized interfering region 16 on the inner body 12. The top 22 of the inner body is open, and the outer body serves as a lid for the inner body when the two bodies are mated in a closed position. Additionally, the top 24 of the outer body may be made transparent to permit a user to view the contents of the package 10.

The polarized interfering regions have planes of polarization that may range from an offset of approximately 0° to approximately 90° depending on a desired level of light transmittance through the interactive interference region 20 (i.e. where the polarized interference regions 16, 18 overlap), with 90° (orthogonal or perpendicular orientation of the two planes of polarization) corresponding to approximately 0% light transmittance and 0° (parallel orientation of the two planes of polarization) corresponding to approximately 100% light transmittance relative to the transmittance of the individual polarized interference regions 16, 18.

According to one example, mating box bodies (e.g., bodies 12, 14) are used to create the described visually interactive effects. In this example, a rectangular box that is approximately 8" high and approximately 2⅝" on a side is considered, although boxes of other shapes and/or dimensions may be considered in accordance with one or more aspects described herein. One or more sides of the inner body of the box include polarized interfering regions. The top of the inner body is open (i.e., the inner body is topless). The outer body in this example is a rectangular transparent sleeve that slides over the "box" (the inner body). The transparent top of the outer body and the topless inner body allow the viewer to see the contents of the box (e.g., candy, cookies, toy, prize, etc.). The sides of the outer body are transparent (e.g., to allow the polarized interference region on the inner body to interact and create an interference effect with the polarized interference region on the outer body), in order to generate a visibly detectable interaction in the interactive interference region as the outer body slides over the inner body (e.g., e.g., during opening or closing of the package). That is when the package is closed, the polarized interference regions 16, 18 are completely aligned and overlapping, blocking light transmission in two planes, and the interactive interference region 20 is at its largest size. As the package is opened and the polarized interference regions are slid past each other, the interactive interference region shrinks, and a greater amount of light is permitted through the non-overlapping portions of the polarized interference regions 16, 18 since they each block light transmission in only one plane. When the transparent outer body is slid off of the inner body to open the package or box, the sides of the box display changing light transmittance, as shown in FIG. 1. Fewer than all of the sides, and/or less than all of the area of a given side of the inner or outer body need be constructed with an interfering region to fall within the scope of the various embodiments described herein. For example, one or more regions of one or more sides may contain text, logos, or graphics associated with the product housed in the box or package.

Figure 2:
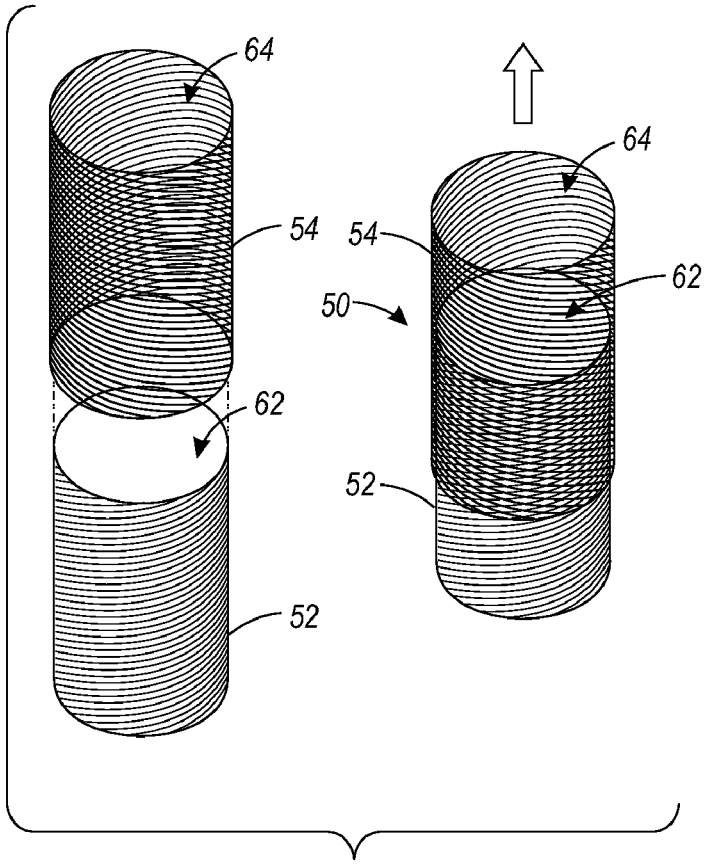
FIG. 2 illustrates an example of a tubular or cylindrical package that opens in a manner that creates a dynamic visual effect via moving polarized interference regions.

FIG. 2 illustrates an example of a tubular or cylindrical package 50 that opens in a manner that creates a dynamic visual effect via moving polarized interference regions. The package 50 includes an inner body 54 and a transparent (e.g., fully transparent, semi-transparent, etc.) outer body 54 (e.g., a sleeve), such that the outer body 54 is slid off the inner body 52 to open the package 50. The inner body 52 has a polarized interference region 56 on at least a portion of its outer surface, and the outer body 54 has a polarized interference region 58 printed on one or both of its surfaces. As the outer body is slid or pulled off of the inner body, an interactive interference region 60 changes due to the change in relative positions of respective polarized interference regions 56, 58 with respect to each other. More generally stated, at least a portion of the outer body 54 is transparent to one polarization (e.g., approximately 30-50% light-transmissive) and is marked with a polarized interference region 58, and at least that portion of the outer body is slid past a polarized interference region 56 printed on the inner body 52. The top 62 of the inner body is open, and the outer body 54 serves as a lid for the inner body 52 when the two bodies are mated together in a closed position. Additionally, the top 64 of the outer body may be made transparent to permit a user to view the contents of the package 50. The interfering regions of the packages described with regard to FIGS. 1 and 2 comprise polarized material (e.g., glass, plastic, etc.) that polarizes light waves traversing the material. For instance, the inner body may comprise a polarized plastic or glass window (e.g., a transmissive filter of any suitable material), wherein a plane of polarization is aligned in a first orientation, and the outer body may comprise a polarized plastic or glass window on a corresponding region of the outer body. The polarized window on the outer body has a plane of polarization aligned in a second orientation (e.g., offset 0° to 90° relative to the first orientation). For example, the plane of polarization in the second orientation may be orthogonal or perpendicular to the plane of polarization in the first orientation. In this manner, light passes through the windows (polarized interference regions) on the inner body and the outer body when the package is open at a first transmittance level, but as the package is closed, the windows become opaque where they overlap, since light is blocked by the orthogonal lenses or windows. Once the package is completely closed the windows are aligned and the interactive interference region formed thereby is completely dark. This feature may be useful for packaging photosensitive materials, since a user can tell when the package is completely closed, and since light is prevented from entering the package when closed due to the additive effect of the orthogonal transmissive filters.

According to another example, the first and second orientations are varied depending on the contents of the package. For instance, the second orientation may be rotated 30° from parallel relative to the first orientation for packages containing a first product, 60° from parallel for packages containing a second product, and 90° from parallel (e.g., perpendicular) for packages containing a third product. To further this example, the package may be designed for sunglasses of varying lens darkness, where packages for glasses with lighter lenses include an outer body window employing the 30° from parallel orientation relative to the plane of polarization of the inner body window. Packages for glasses with medium lenses employ an outer body with the 60° from parallel orientation, and so on. In this manner, a single, standard inner body can be used for all packages, with varied outer bodies. Conversely, a standard outer body window polarization orientation can be employed, with varied inner body window orientations. In yet another example, the polarized windows on the inner and outer bodies can be arranged such that when the package is closed, the aligned windows approximate the darkness of the lenses of the sunglasses for which the package is intended.

Figure 3:
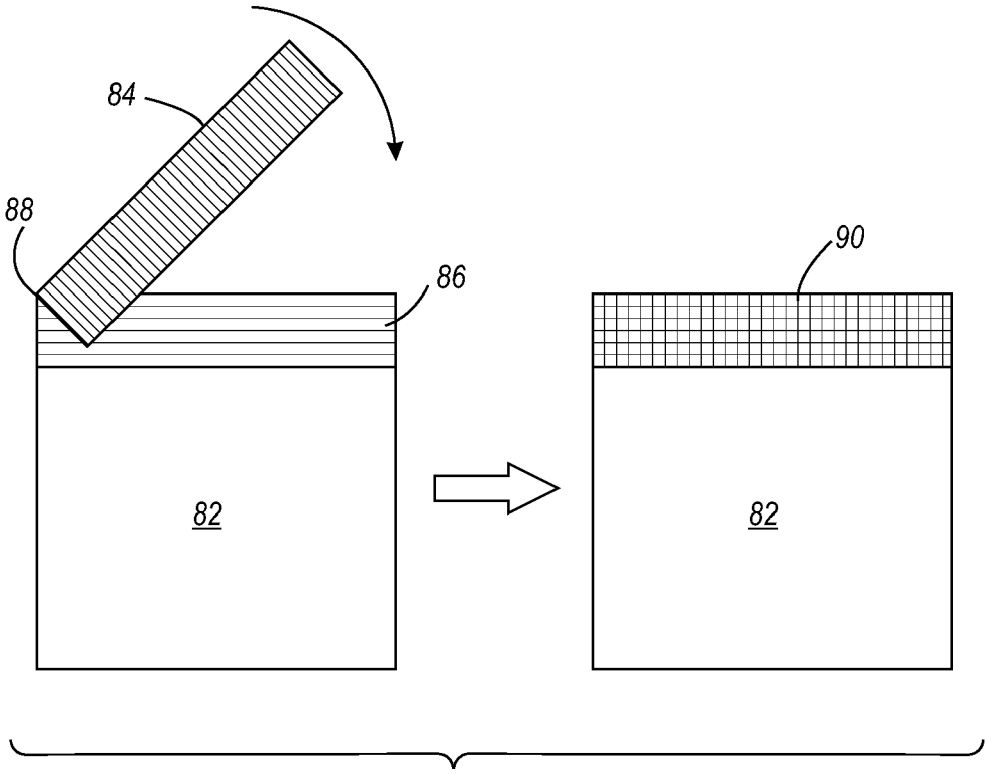
FIG. 3 illustrates an example of a package or box comprising a body or main portion in which an item is placed, and a lid portion that fits over a top of the body.

FIG. 3 illustrates an example of a package or box 80 comprising a body 82 or main portion in which an item is placed, and a lid portion 84 that fits over a top of the body 82. In one embodiment, the lid 84 (or sides thereof) is transparent, and the sides of the lid that overlap the body 82 when in a closed position The sides of the lid 80 and the upper region 86 of the body 82 are formed of polarized transparent material (e.g., glass, plastic, or some other suitable material). In one example, the lid 84 is coupled to the body 82 along one edge of the body (extending into the page of FIG. 3), which serves as an axis of rotation about which the polarized interference region on the lid is rotated. The polarized material on the lid 84 sides and the polarized material on the upper region 86 of the body can be arranged orthogonally to each other, such that when the lid 84 is in a closed position, the top of the body appears as an opaque region 90. As the lid is rotated about the axis 88, the plane of polarization of the filter on the lid sides pivots with respect to the orientation of the plane of polarization on the upper region 86 of the body, 82, creating varied tint or transmittance in portions of the lid sides that overlap with the upper region 86 of the package body 82.

Figure 4:
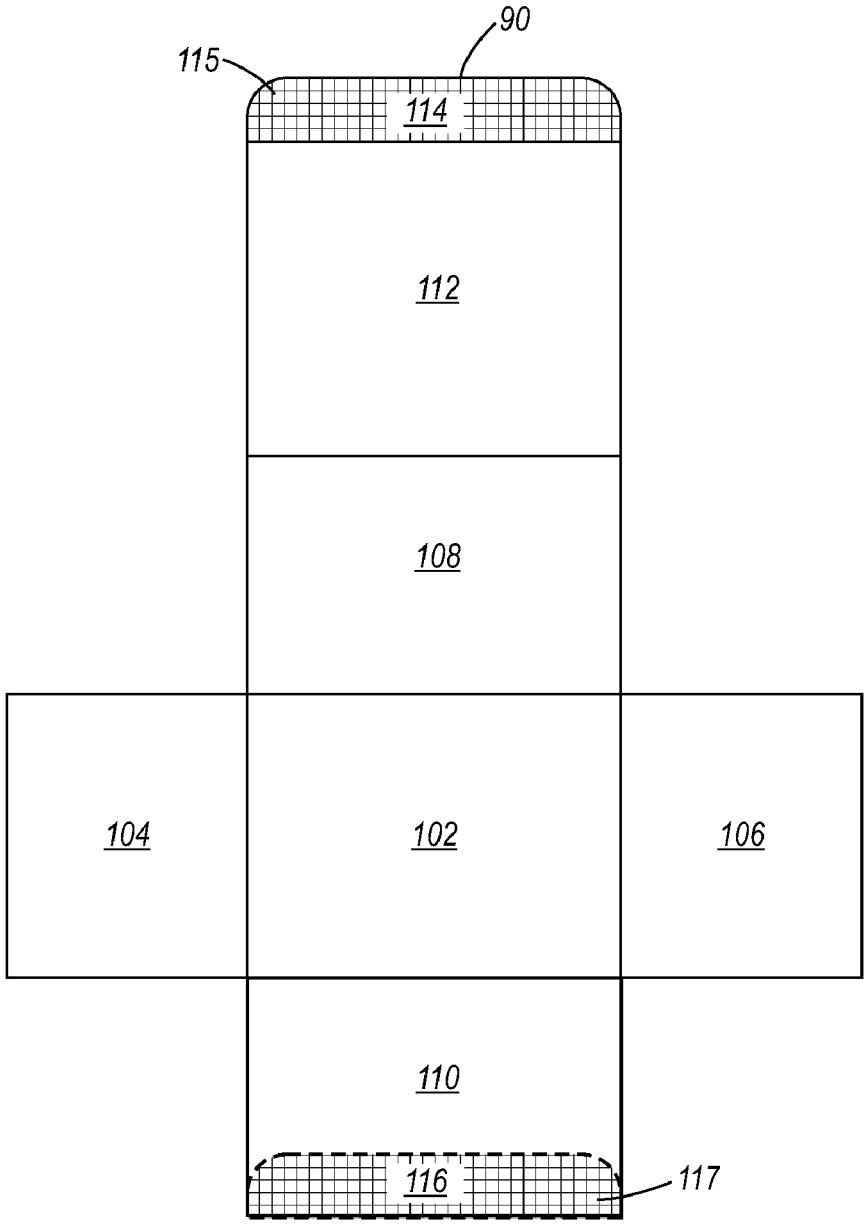
FIG. 4 illustrates an example of a box pattern that can be employed in conjunction with the various systems and methods described herein.

FIG. 4 illustrates an example of a box pattern 100 that can be employed in conjunction with the various systems and methods described herein. The box pattern 100 includes a bottom panel 102, a first side panel 104, a second side panel 106, a third side panel 108, and a fourth side panel 110. The third side is further coupled to a top side 112, which in turn is coupled to a flap 114 that tucks into the box top close the box when assembled. The flap 114 includes an interference region 115 (e.g., a light-transmissive filter or other polarized material, etc). The fourth side panel 110 includes a complementary region 116 that includes a corresponding or complementary interference region 117 or transmissive filter. The complementary region 116 may be transparent to one polarization in accordance with various aspects, to interact with the interference region 115 on the flap 114, in order to generate a visible interference effect during opening and closing of the box. It will be appreciated that any suitable box or box pattern may be used in conjunction with the various systems and methods described herein. A number of such suitable box patterns are defined according to the European Carton Maker's Association (ECMA).

Figure 5:
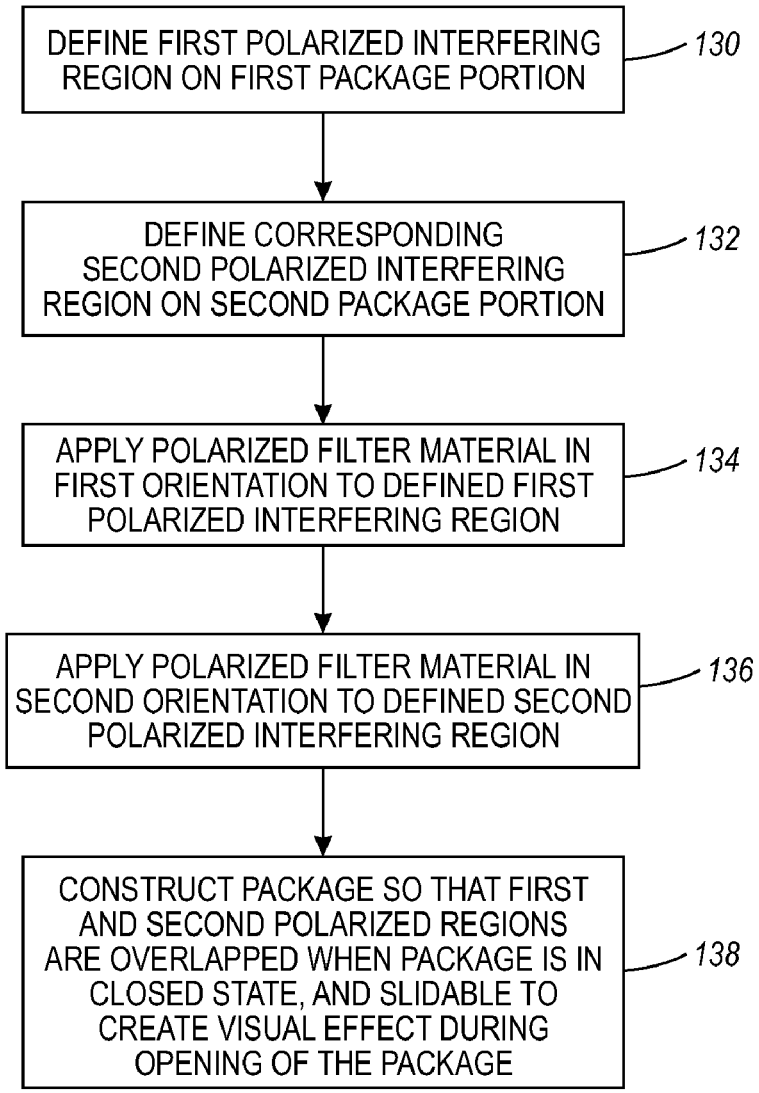
FIG. 5 illustrates a flow diagram for a method of providing an interactive visual display for a user upon the user interacting with a package on which the visual display is presented.

FIG. 5 illustrates a flow diagram for a method of providing an interactive visual display for a user upon the user interacting with a package on which the visual display is presented. At 130, a first interfering region on a first package portion is defined. At 132, a second interfering region is defined on a second package portion. The first and second package portions may be separate (e.g., a tube and sleeve as shown in FIGS. 1 and 2) or may be distinct portions of a single package body (e.g., the boxes shown in FIGS. 3 and 4).

At 134, a polarizing material (e.g., a transmissive filter material or the like) is applied to the first package portion in the first interfering region, in a first orientation (e.g., a plane of polarization). At 136, the polarizing material is applied to the second package portion in the second interfering region in a second orientation that is rotated between 0° and 90° relative to the first orientation.

At 138, a package is constructed so that the first and second polarized interfering regions are aligned when the package is closed, and such that the first and second interfering regions slide past each other during opening or closing of the package to create an interactive visual effect in which the shape and size of an interactive interference region in which the polarized interference regions overlap changes, wherein the interactive interference region has a reduced transmittance relative to the individual interference regions.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A package that generates a moving visual effect when opened or closed, comprising:

a first package portion with a first polarized interference region on a surface thereof, the polarized interference region having first plane of polarization;

a transparent second package portion with a second polarized interference region having a second plane of polarization that is oriented at an angle in the range of 0° to 90° relative to the first plane of polarization;

wherein the first and second polarized interference regions are aligned and overlapping when the package is closed, thereby forming an interactive interference region; and wherein the first and second polarized interference regions are slidable past each other during opening and closing of the package, thereby creating the moving visual effect, in which the shape and size of the interactive interference region changes.

2. The package of claim 1, wherein the first package portion is tube-shaped with a closed bottom surface and an open top.

3. The package of claim 2, wherein the first package portion is cylindrical.

4. The package of claim 3, wherein the second package portion is cylindrical with a closed top surface and an open bottom, and wherein the second package portion is slidable over the first package portion to close the package.

5. The package of claim 2, wherein the first package portion comprises three or more sides coupled to the closed bottom surface.

6. The package of claim 5, wherein the second package portion has the same number of sides as the first package portion, a closed top surface, and an open bottom, and wherein the second package portion is slidable over the first package portion to close the package.

7. The package of claim 2, wherein the second package portion is tube-shaped with a closed top surface and an open bottom, and wherein the second package portion is slidable over the first package portion to close the package.

8. The package of claim 1, wherein the first and second polarized interference regions extend over the entire first and second package portions, respectively.

9. The package of claim 1, wherein the first polarized interference region covers less than all of the first package portion, and wherein the second polarized interference region comprises a transparent polarized window.

10. The package of claim 9, wherein the first polarized interference region comprises polarizing material deposited thereon such that light passing through the first polarized interference region is polarized in a first plane, and wherein the second polarized interference region comprises polarizing material deposited thereon such that light passing through the second polarized interference region is polarized in a second plane, wherein the first and second planes are not parallel.

11. The package of claim 10, wherein the first and second planes are orthogonal to each other, such that no light passes through the overlapping portions of the first and second polarized interference regions.

12. The package of claim 10, wherein the first and second planes are oriented with an offset relative to each other, the offset being in the range of approximately 1° to approximately 89° from parallel.

13. The package of claim 10, wherein the first and second interference regions are formed of at least one of a transparent plastic and cellophane.

14. A method of generating a changing visual effect during opening and closing of a package, comprising:

defining a first polarized interference region on a first package portion;

defining a second polarized interference region on a second package portion that mates with the first package portion to form the package;

applying a polarizing material to the first polarized interference region that polarizes light in a first plane of polarization;

applying the polarization material to the second polarized interference region that polarizes light in a second plane of polarization that is oriented at an angle in the range of 0° to approximately 90° relative to the first plane of polarization; and mating the second package portion to the first package portion to form the package;

wherein the first and second polarized interference regions are aligned and overlapping when the package is in a closed state; and wherein the first and second package portions are slidable relative to each other and create a changing visual effect when the polarized interference regions slide past each other during opening or closing of the package.

15. The method of claim 14, wherein the first package portion is cylindrical and wherein the second package portion is cylindrical with a closed top surface and an open bottom, and wherein the second package portion is slidable over the first package portion to close the package.

16. The method of claim 14, wherein the first package portion comprises three or more sides coupled to the closed bottom surface, and wherein the second package portion has the same number of sides as the first package portion, a closed top surface, and an open bottom, and wherein the second package portion is slidable over the first package portion to close the package.

17. The method of claim 14, wherein the first polarized interference region covers less than all of the first package portion, and wherein the second polarized interference region comprises a transparent polarized window.

18. The method of claim 14, wherein the first and second polarized interference regions extend over the entire first and second package portions, respectively.

19. The method of claim 14, wherein the first and second planes of polarization are orthogonal to each other, such that no light passes through the aligned interference regions when the package is closed.

20. The method of claim 14, wherein the first and second planes of polarization are oriented with an offset relative to each other, the offset being in the range of approximately 1° to approximately 89° from parallel.

* * * * *